US006631602B2

(12) United States Patent
Wagner

(10) Patent No.: US 6,631,602 B2
(45) Date of Patent: Oct. 14, 2003

(54) APPARATUS FOR INSTALLING WALL INSULATION

(75) Inventor: Jeffrey P. Wagner, Beafort, SC (US)

(73) Assignee: Therm-All, Inc., North Olmsted, OH (US)

( * ) Notice: Subject to any disclaimer, the term of this patent is extended or adjusted under 35 U.S.C. 154(b) by 0 days.

(21) Appl. No.: 09/825,186

(22) Filed: Apr. 3, 2001

(65) Prior Publication Data

US 2002/0053181 A1 May 9, 2002

Related U.S. Application Data

(60) Provisional application No. 60/194,750, filed on Apr. 5, 2000.

(51) Int. Cl.[7] ..... E04B 1/00

(52) U.S. Cl. ..... 52/749.1; 52/746.11; 242/557

(58) Field of Search ..... 52/750, 749.1, 52/746.11; 242/592, 598.6, 557, 403

(56) References Cited

U.S. PATENT DOCUMENTS 3,992,847 A * 11/1976 Heath ..... 156/577
4,078,355 A * 3/1978 Clemensen ..... 242/419.6
4,383,398 A 5/1983 Tipton
4,864,837 A * 9/1989 Fielden, Jr. ..... 52/749.12
5,664,740 A * 9/1997 Alderman et al. ..... 242/592
5,685,123 A * 11/1997 Alderman et al. ..... 242/557
5,911,385 A * 6/1999 Neifer et al. ..... 105/150
5,921,057 A * 7/1999 Alderman et al. ..... 242/566

* cited by examiner

*Primary Examiner*—Carl D. Friedman
*Assistant Examiner*—Basil Katcheves
(74) *Attorney, Agent, or Firm*—Wegman, Hessler & Vanderburg

(57) ABSTRACT

A carriage having a base frame supported on rolling elements, and an upper frame tiltably supported on the base frame for leveling the upper frame when the base frame is inclined from side-to-side. The upper frame supports at least three rolls of insulation. The carriage is supported on the framework of a building roof and moves along a building wall for dispensing vertical lengths of insulation which are secured to the wall.

15 Claims, 6 Drawing Sheets

APPARATUS FOR INSTALLING WALL INSULATION

RELATED APPLICATIONS

This application claims subject matter disclosed in U.S. provisional application Ser. No. 60/194,750 filed Apr. 5, 2000, the benefit of the filing date of which is hereby claimed.

BACKGROUND OF THE INVENTION

This application relates to the art of building insulation and, more particularly, to apparatus for use in installing insulation on building walls. Although the invention is particularly applicable for use in the installation of building wall insulation, it will be appreciated that the apparatus of the present application can be used for installing other flexible material and that certain features of the invention may be used for other purposes.

During the fabrication of metal frame buildings, wall installation commonly is installed by placing a roll of insulation on a carriage and supporting the carriage on the building roof framework. The carriage travels across the roof along a side wall as strips of insulation are dispensed from the roll and secured to the building wall. Typical apparatus of this type is disclosed in U.S. Pat. Nos. 3,992,847 and 4,078,355. In another arrangement disclosed in U.S. Pat. No. 4,383,398, a cage that is supported on the tines of a forklift carries two rolls of insulation with one being above the other.

When apparatus of the type described is used along a portion of the roof that is horizontal, the insulation hangs straight down for easy installation. However, when such apparatus is used along a building wall where the roof slopes from one end of the wall to the other, the carriage is inclined to the horizontal from side-to-side and strips of insulation do not hang straight down from the carriage. Therefore, it would be desirable to have an arrangement for leveling the axis of the roll of insulation when the carriage is inclined.

The carriage tends to slide or lose traction when traveling uphill on a sloping roof, and it would be desirable to provide a positive drive arrangement to insure that the carriage will not slip and will be positively driven.

Apparatus of the type described commonly supports only one roll of insulation or a second roll that is not conveniently movable to a dispensing position. It would be desirable to have an arrangement for supporting at least three rolls of insulation so that all or a significant portion of a building wall may be insulated before it is necessary to reload the carriage with additional rolls of insulation.

SUMMARY OF THE INVENTION

Apparatus of the type described comprises a carriage having a base frame on which an upper frame is tiltably supported. When the base frame is inclined to the horizontal from side-to-side, the upper frame can be tilted relative to the base frame for leveling the axis of an insulation roll supported thereon.

In a preferred arrangement, the upper frame supports at least three rolls of insulation on a pair of spaced-apart parallel elongated rails. The rails preferably are provided with teeth along their upper surfaces, and the insulation rolls have mandrels with toothed sprockets to prevent skewing of an insulation roll when it is moved along the rails. An insulation dispensing station at the front end of the rails holds an insulation roll against movement while allowing rotation thereof for dispensing strips of insulation material.

The base frame is supported by rolling elements that are positively driven. The rolling elements have cylindrical hubs and radial flanges that are circumferentially toothed to function as cogwheels. When the carriage moves along horizontal purlins, it is supported on the cylindrical hubs of the rolling elements with the flanges on the upslope side of the purlins for holding the carriage on the roof frame work. When the carriage travels along a sloping roof, strut members are clamped or otherwise temporarily secured to the roof purlins. The struts have spaced-apart slots in the webs to function as cogwheel tracks that are engaged by the cogwheels on the rolling elements to provide a positive cogwheel-type of drive.

It is a principal object of the present invention to provide an improved carriage for use in installing building wall insulation.

It is another object of the invention to provide such a carriage that permits leveling of an insulation roll supported thereon even though the carriage base may be inclined to the horizontal from side-to-side.

It is a further object of the invention to provide such a carriage having a plurality of positively driven rolling elements for moving the carriage along a building roof framework.

DESCRIPTION OF A PREFERRED EMBODIMENT

Figure 1:
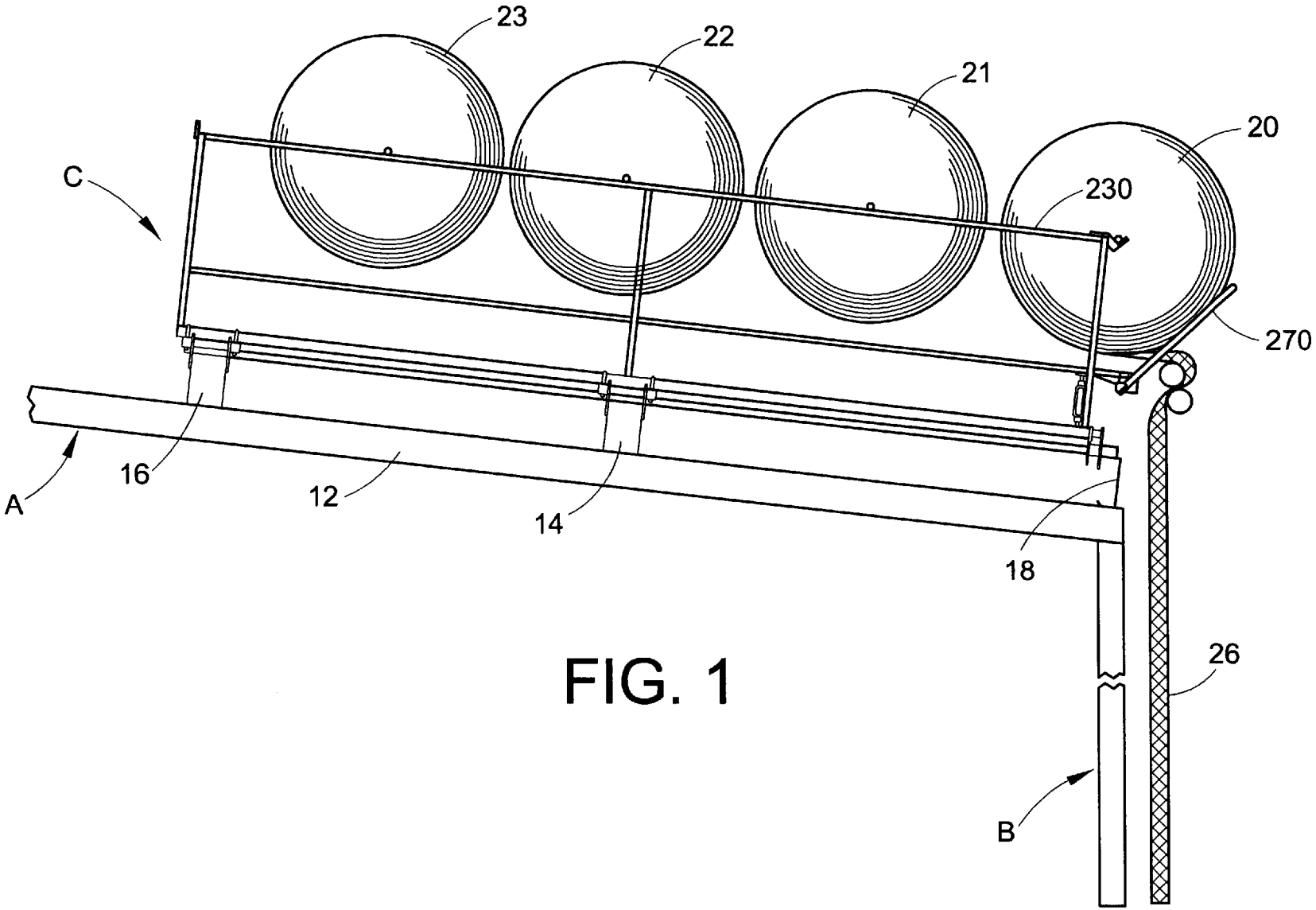
FIG. 1 is a partial side elevational view of a portion of a building roof framing and building side wall framing, and with the carriage of the present application supported on the building roof.

Referring now to the drawing, wherein the showings are for purposes of illustrating a preferred embodiment of the invention only and not for purposes of limiting same, FIG. 1 shows a portion of a metal frame building having a roof frame A and a vertical wall frame B. Roof A includes a plurality of spaced-apart roof supports, only one of which is indicated at 12 in FIG. 1. These roof supports slope upwardly from right-to-left as shown in FIG. 1. A plurality of spaced-apart purlins 14, 16 and an eave channel 18 are supported on the roof support members. The purlins and the eave channel extend horizontally from one end to the other but are located at different elevations. Thus, eave channel 18 is at the lowest elevation while purlins 14 and 16 are at progressively higher elevations.

A carriage C in accordance with the present application is supported on purlins 14, 16 and eave channel 18 for travel in a horizontal path along side wall B. Carriage C supports rolls of insulation 20–23 for use in insulating wall B. FIG. 1 shows a vertical length 26 of insulation hanging downwardly from roll 20 on carriage C along building wall B. The bottom end portion of insulation length 26 is attached adjacent the bottom of wall B by screws or other suitable fasteners.

A tensioning mechanism on carriage C pulls upwardly on insulation length 26 for tensioning same while building panels are installed over the length of insulation 26 and attached to the frame members of wall B. The insulation length is then severed adjacent the top of wall B and the carriage is moved horizontally to a new position for installing an additional length of insulation along wall B. This process is repeated until the entire wall is covered with insulation and panels.

Figure 2:
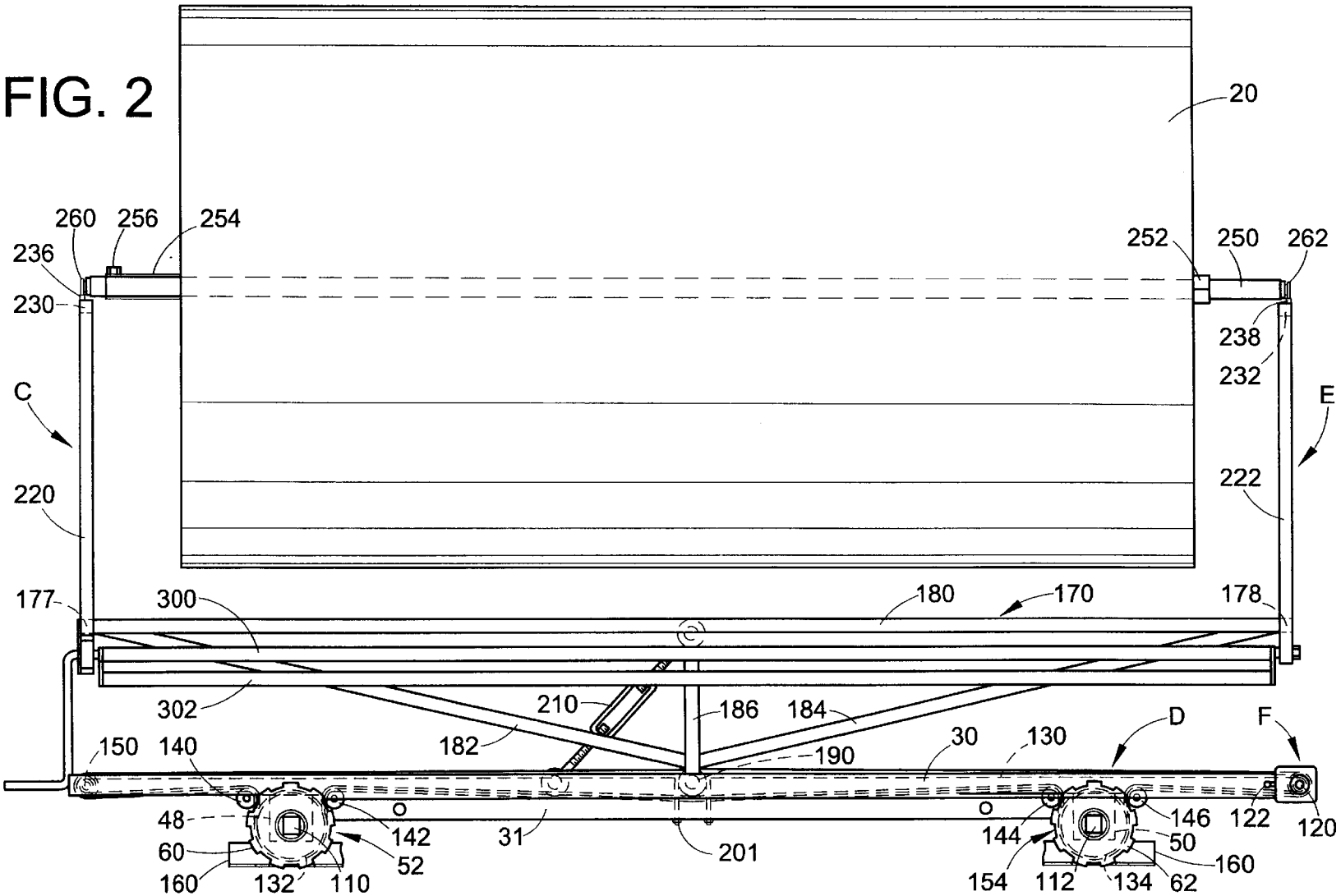
FIG. 2 is a front elevational view of a carriage in accordance with the present application.
Figure 3:
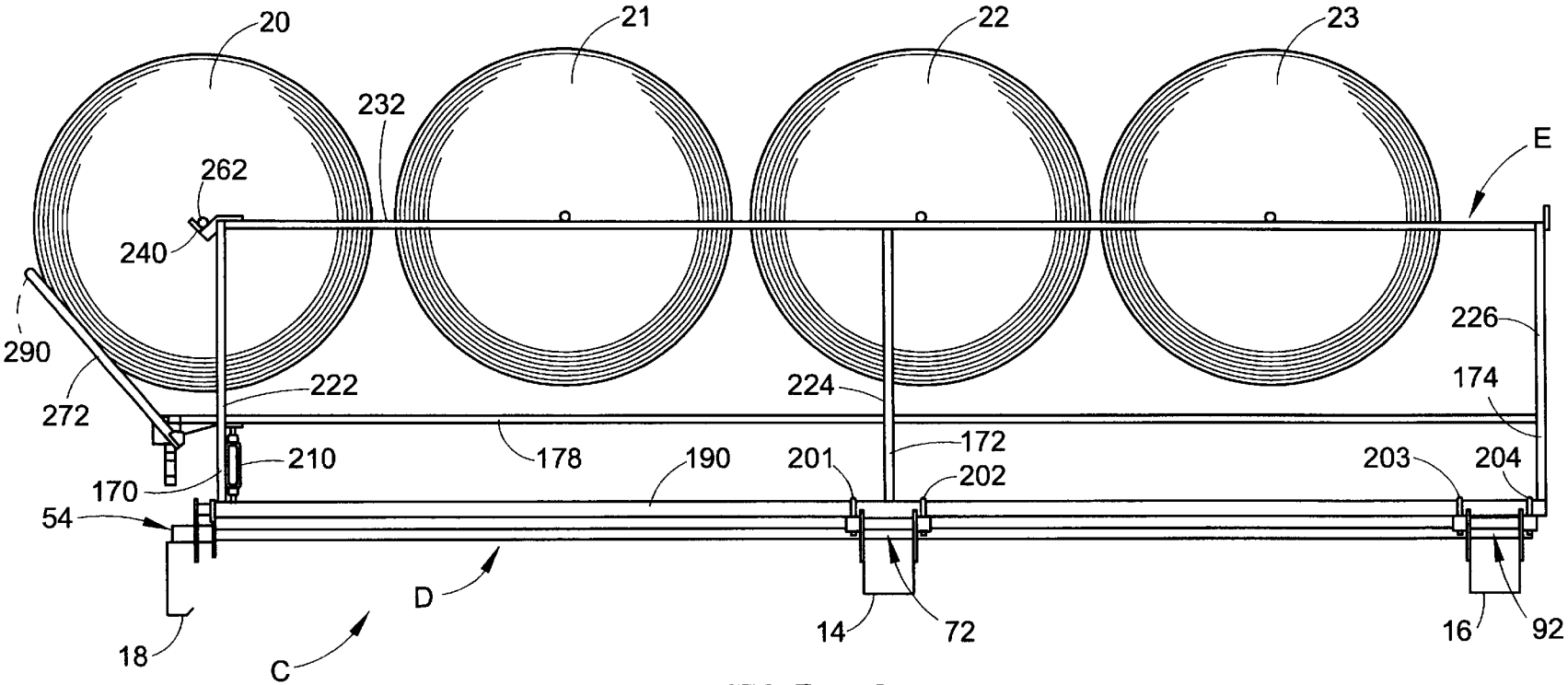
FIG. 3 is a side elevational view of a carriage in accordance with the present application.
Figure 4:
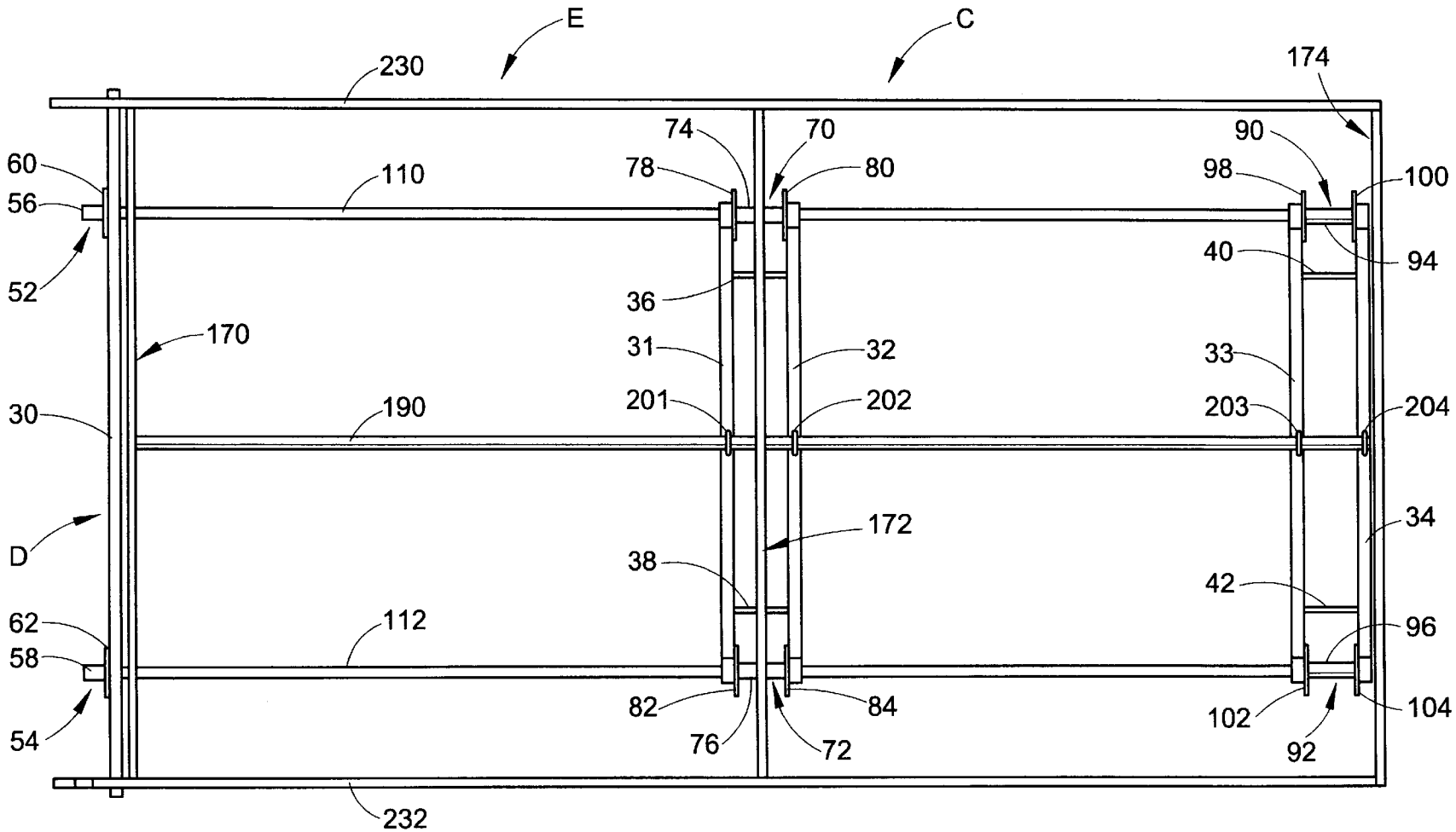
FIG. 4 is a top plan view of a carriage in accordance with the present application.

Referring now to FIGS. 2–4, carriage C includes a base frame D having an upper frame E tiltably supported thereon for tilting movement from side-to-side. Base frame D includes a transverse front frame member 30, a pair of parallel spaced-apart intermediate transverse frame members 31, 32, and a pair of spaced-apart parallel transverse rear base frame members 33, 34. Spacer rods 36, 38 and 40, 42 are positioned between intermediate base frame members 31, 32 and rear base frame members 33, 34 as shown in FIG. 4.

Bearing blocks 48, 50 secured to the underside of front base frame member 30 rotatably support front rolling elements 52, 54 for rotation about axes extending front-to-rear of the carriage. Each front rolling element 52, 54 has a cylindrical hub 56, 58 and a radially extending circular flange 60, 62. Each flange 60, 62 is shaped to have teeth on its outer periphery as shown in FIG. 2 to form cogwheels.

Bearing blocks attached to the ends of intermediate frame members 31, 32 rotatably support intermediate rolling elements 70, 72 for rotation about axes coincidental with the rotational axes of front rolling elements 52, 54. Each intermediate rolling element includes a cylindrical hub 74, 76, and a pair of cogwheels or toothed flanges 78, 80 and 82, 84.

Figure 5:
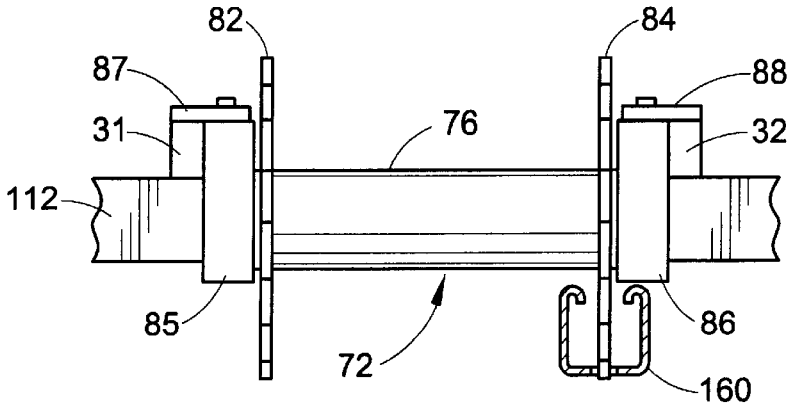
FIG. 5 is a partial side elevational view of a rolling element engaging a track.
Figure 6:
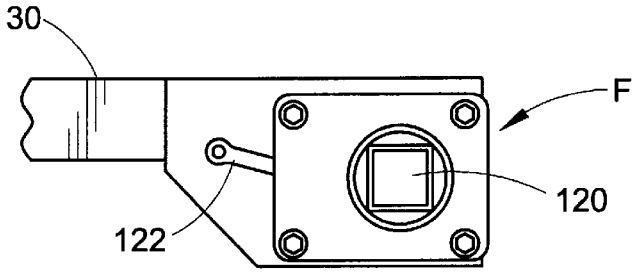
FIG. 6 is a partial front elevational view of a ratchet clutch used for driving the rolling elements.
Figure 7:
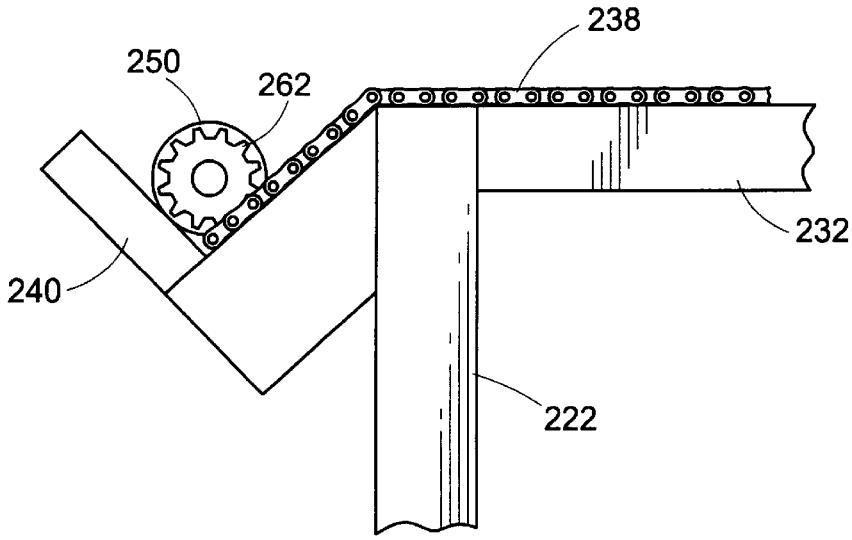
FIG. 7 is a partial side elevational view showing a generally V-shaped insulation dispensing station at the front end of an insulation support rail for holding the ends of a mandrel.

FIG. 5 shows the outer end portions of cylindrical hub 76 supported in bearing blocks 85, 86 attached to frame members 31, 32 by brackets 87, 88. The other rolling elements are rotatably supported in a similar manner.

Rear rolling elements 90, 92 are rotatably supported in bearing blocks at the opposite ends of rear base frame members 33, 34 for rotation about axes coincidental with the rotational axes of front and intermediate rolling elements 52, 54, 70 and 72. Each rear rolling element 90, 92 includes a cylindrical hub 94, 96 and a pair of spaced-apart cogwheels or flanges 98, 100 and 102, 104.

The hollow interior of the cylindrical hubs on each rolling element are shaped and dimensioned to drivingly receive a square drive shaft. One drive shaft 110 extends through rolling elements 52, 70 and 90, while square drive shaft 112 extends through rolling elements 54, 72 and 92. The opposite ends of drive shafts 110, 112 have tapped bores therein for receiving bolts that extend axially into the hubs of rolling elements 52, 90 and 54, 92 in cooperation with washers or cap members that bear against the hub ends to hold the drive shafts against longitudinal displacement.

As best shown in FIG. 2, a ratchet clutch F is attached to one end portion of front frame member 30. By way of example, ratchet clutch F may be of the type marketed by Lowell Corporation as part no. 71901. Ratchet clutch F includes a drive projection 120 for receiving a hand crank and a reversing lever 122. In one position of lever 122, ratchet clutch F may be rotated clockwise while being locked against rotation counterclockwise. In the opposite position of the lever, the ratchet clutch may be rotated counterclockwise while being locked against clockwise rotation.

A continuous roller chain 130 extends around a drive sprocket on ratchet clutch F, and around drive sprockets 132, 134 on front rolling elements 52, 54. Chain 130 also extends around idler sprockets 140, 142 adjacent front rolling element 52 and around idler sprockets 144, 146 adjacent front rolling element 54. Chain 130 extends around an idler sprocket 150 adjacent the opposite end of front frame member 30 from ratchet clutch F. By cranking ratchet clutch F, all of the rolling elements are rotated in unison. Driving force is applied to both front rolling elements 52, 54 through roller chain 130. The same driving force is transferred from front rolling elements 52, 54 through drive shafts 110, 112 to the intermediate and rear rolling elements 70, 72, 90 and 92.

When the rolling elements are supported on horizontal purlins and an eave channel as shown in FIG. 3, the hubs of the rolling elements rest on the upper surfaces of the purlins and the eave channel. The cogwheels or flanges on the rolling elements project down along the sides of the purlins and eave channel to prevent the carriage from sliding. Thus, when the carriage is inclined upwardly from left-to-right in FIG. 3, which is from front-to-back, the cogwheels on the rolling elements prevent downward sliding of the carriage and hold the carriage on the roof framework.

When the carriage is used along the building walls having a roof that slopes upwardly in a direction along the length of the wall, the carriage travels in a direction perpendicular to the length of the purlins. Channel-shaped struts as indicated at 160 are clamped or otherwise temporarily secured perpendicular to the roof purlins parallel to the wall along which the carriage will travel.

The temporary strut members have spaced-apart slots longitudinally in the channel web for receiving the teeth on the cogwheels of the rolling elements. This arrangement is illustrated in FIGS. 1 and 5 wherein the cogwheel teeth are received in the channel slots for positively driving the carriage upwardly along an upwardly sloping roof. Thus, the strut channel forms strut track or cogwheel track for cooperation with the cogwheels on the rolling elements. The cogwheels and the ratchet clutch also hold the carriage against slippage back down the slope.

Upper frame E has front, intermediate and rear trusses 170, 172 and 174. As shown for truss 170 in FIG. 2, each truss includes a horizontal frame member 180, a pair of inclined frame members 182, 184 that are downwardly inclined toward one another from the opposite ends of horizontal frame member 180, and a central vertical frame member 186. Frame members 182, 184 and 186 are welded or otherwise suitable secured together at their central intersection and are also welded or otherwise secured to a tubular frame member 190 that extends front-to-rear of the carriage centrally thereof parallel to the rotational axes of the rolling elements. The opposite ends of each side-to-side horizontal frame member 180 in each truss 170, 172, 174 are welded or otherwise secured to parallel front-to-back bottom frame members 177, 178 on upper frame E.

Tubular frame member 190 is secured to intermediate base frame members 31, 32 and rear base frame members 33, 34 by U-bolts 201–204. Loosening the nuts on U-bolts 201 and 202 or 203 and 204 allows adjustment of intermediate frame members 31 and 32 or 33 and 34 along tubular frame member 190 to locate intermediate rolling elements 70 and 72 or rear rolling elements 90 and 92 in a desired position for engaging purlins or strut track.

A turnbuckle 210 attached at one end to front truss 170 vertically above tubular frame member 190 is attached at its opposite end to base frame member 30 outwardly from tubular frame member 190. Adjustment of turnbuckle 210 allows tilting movement of upper frame E relative to base frame D from side-to-side. This allows leveling of the rotational axis of a roll of insulation when the base frame is inclined to the horizontal for travel up a sloping roof line. The tubular frame member provides a hinge axis or leveling axis extending from front-to-rear of the carriage centrally thereof parallel to the rotational axes of the rolling elements to allow tilting of the upper frame from side-to-side.

Upper frame E includes upright front frame members 220, 222 that extend upwardly from bottom frame members 177, 178. There also are pairs of intermediate and rear upright frame members, only one of each being indicated at 224 and 226 in FIG. 3. The upright frame members support a pair of elongated spaced-apart parallel rails 230, 232 extending parallel to the rotational axes of the rolling elements and having toothed upper surfaces. In one arrangement, lengths of roller chain 236, 238 may be welded along the length of the rails to provide the teeth. The front ends of the rails terminate in a generally V-shaped insulation dispensing station 240 at which the mandrel of an insulation roll is held against movement while permitting rotation of the insulation roll to dispense insulation therefrom.

The insulation rolls typically are wound on a rigid hollow cardboard core. A mandrel 250 having a collar 252 secured thereto adjacent one end thereof is inserted through a cardboard core until collar 252 engages the core. Another collar 254 then is placed over the opposite end portion of the mandrel close to the cardboard core and attached to the mandrel by thumbscrew 256.

The opposite ends of mandrel 250 have sprockets 260, 262 secured thereto against rotation relative thereto. The toothed sprockets engage roller chains 236, 238 on rails 230, 232 in a rack and pinion relationship to prevent skewing of an insulation roll relative to rails 230, 232 when an insulation roll and its mandrel are moved therealong. Each roll of insulation that is supported on the rails has a similar mandrel and sprocket arrangement so that one end of a mandrel cannot rotate unless the other end also rotates along the toothed rails. The cardboard core and the insulation coiled thereon rotate relative to the mandrel.

The end portions of all of the mandrels for all of the insulation rolls may be tied together or otherwise connected by separable links so that when a first insulation roll 20 is depleted and roll 21 is pulled to dispensing station 240, the trailing rolls 22 and 23 will follow so as to be in position for use and to better balance the carriage.

The front end of the carriage includes a brake device for applying a braking force to a roll of insulation to prevent same from overrunning when a strip of insulation is dispensed therefrom. The front of the carriage also includes a selectively operable gripping mechanism that pinches the strip of insulation and pulls upwardly on same to tension the strip before installation of wall panels over the insulation.

Figure 8:
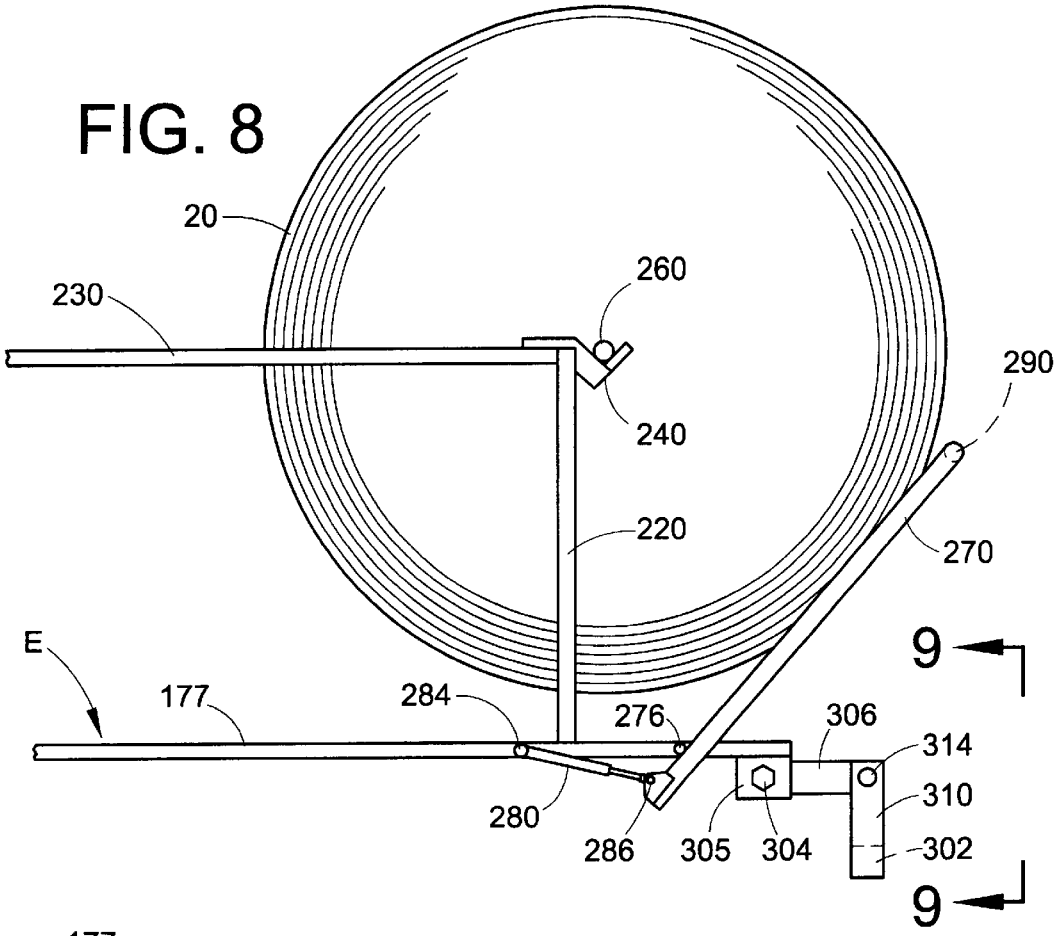
FIG. 8 is a partial side elevational view of the front portion of the carriage upper frame and showing an insulation roll tensioning member that is biased into engagement with a roll of insulation.
Figure 9:
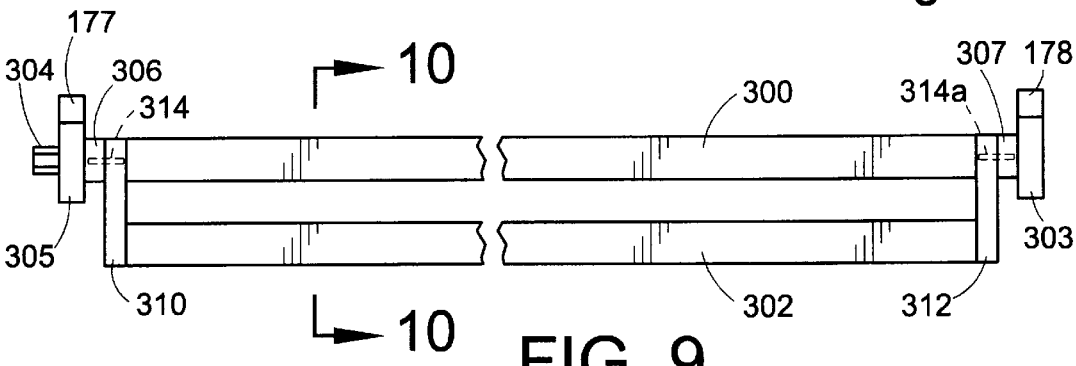
FIG. 9 is a partial front elevational view taken on line 9—9 of FIG. 8.

FIG. 8 shows an insulation roll braking device that includes a pair of parallel arms, one of which is shown at 270 in FIG. 8 and the other at 272 in FIG. 3. Each arm has a horizontal sleeve welded thereto as indicated at 276 in FIG. 8 for arm 270. Sleeve 276 is received over an outwardly projecting horizontal pin 278 on frame member 177 of upper frame E. A pressurized cylinder 280 has its cylinder end connected to frame member 177 at 284 and its rod connected at 286 to arm 270 below pin 276. Cylinder 280 is pressurized so that its rod is biased outwardly to normally pivot arm 270 counterclockwise in FIG. 8 about pin 276.

A horizontal bar 290 is welded across the upper ends of arms 270, 272 and engages the outer periphery of an insulation roll 20. Arms 270, 272 are spaced-apart a distance greater than the width of the insulation material so that the roll can fit between the arms as generally shown in FIG. 3. This allows the horizontal bar 290 to firmly engage across the entire width of the insulation material on the roll to provide a friction drag on the insulation roll as it is rotated when insulation is dispensed therefrom.

FIGS. 8–11 also show a gripping or pinching device for applying tension to a strip of insulation material hanging downwardly from the carriage. A pair of spaced parallel pinch bars 300, 302 extend from side-to-side across the front of the carriage in spaced relationship to one another. Pinch bar 300 is rotatably attached to the front end portion of frame members 177, 178 on upper frame E for rotation relative thereto by way of a bearing block 303 and a reversible ratchet clutch 305 of the same type as described with reference to ratchet clutch F. A stub drive shaft 304 on ratchet clutch 305 receives a hand crank for rotating same.

Figure 10:
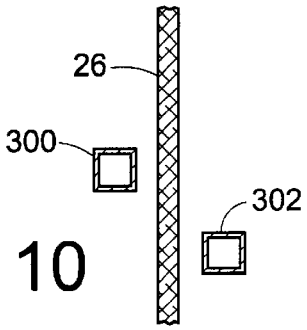
FIG. 10 is a partial cross-sectional elevational view taken on line 10—10 of FIG. 9 and showing a length of insulation material passing between a pair of pinch bars.

Links 306 and 307 extend radially from the end portions of pinch bar 300 for rotation therewith, while pinch bar 302 is supported between links 310, 312 which are hingedly connected at their upper ends as at 314 and 314*a* to links 306 and 307. When insulation is dispensed, ratchet clutch 305 is rotated to provide maximum horizontal or front-to-rear spacing between pinch bars 300, 302 as shown in FIGS. 8 and 10. The insulation then travels downwardly through the space between pinch bars 300, 302 as shown in FIG. 10.

Figure 11:
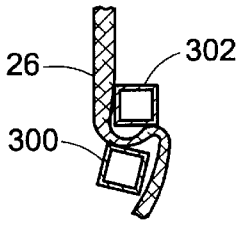
FIG. 11 is a view similar to FIG. 10 with the pinch bars rotated to pinch the insulation therebetween and apply an upward pulling force thereon to tension the length of insulation material.

After the strip of insulation material has been attached to the bottom of the building wall, a crank is applied to stub drive shaft 304 and rotated counterclockwise in FIG. 8. This causes links 310, 312 to rotate clockwise about hinge connections 314 so that pinch bar 302 moves closer to pinch bar 300 for pinching strip 26 of insulation therebetween as shown in FIG. 11. Further counterclockwise rotation of the crank pulls upwardly on insulation strip 26 to tension same while the wall panels are installed. The ratchet clutch is reversed to reposition the pinch bars and release the insulation after it has been severed below the pinch bars.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. Apparatus for installing insulation on building walls comprising:

a carriage including a base frame and an upper frame, said base frame having front and rear ends and opposite sides;

said upper frame including an insulation roll support that supports a roll of insulation about a roll axis;

said base frame having rolling elements that provide movement of said base frame in a direction parallel to the roll axis, said rolling elements including a pair of spaced-apart front rolling elements adjacent said frame front end and a pair of spaced-apart rear rolling elements adjacent said frame rear end, and a drive mechanism that rotatably drives all of said rolling elements in unison;

said upper frame being tiltably mounted on said base frame for movement about a leveling axis that extends parallel to the base frame and perpendicular to the roll axis to provide leveling of the roll axis when the base frame is inclined from side-to-side in its direction of movement.

2. The apparatus of claim 1 wherein said upper frame includes a roll brake biased in a direction to engage the outer surface of an insulation roll supported by said insulation roll support.

3. The apparatus of claim 1 including a selectively operable insulation gripping device on said upper frame that selectively grips and holds the upper end portion of an insulation strip hanging downwardly from said upper frame.

4. The apparatus of claim 1 wherein said insulation roll support is elongated in a direction parallel to said leveling axis to support a plurality of rolls of insulation.

5. Apparatus for installing insulation on building walls comprising:

a carriage including a base frame and an upper frame;

said upper frame including an insulation roll support that supports a roll of insulation about a roll axis, wherein said insulation support includes a pair of spaced-apart toothed rails engageable by toothed sprockets at opposite ends of an insulation roll;

said base frame having rolling elements that provide movement of said base frame in a direction parallel to the roll axis;

said upper frame being tiltably mounted on said base frame for movement about a leveling axis that extends parallel to the base frame and perpendicular to the roll axis to provide leveling of the roll axis when the base frame is inclined from side-to-side in its direction of movement, wherein said insulation roll support is elongated in a direction parallel to said leveling axis to support at least three rolls of insulation.

6. The apparatus of claim 5 wherein said rails terminate at an insulation dispensing station at which an insulation roll is rotatable about the roll axis while being held against movement along the rails.

7. The apparatus of claim 1 wherein said drive mechanism includes flexible drive elements interconnecting said pair of front rolling elements and said pair of rear rolling elements, and drive shafts interconnecting said front and rear rolling elements.

8. The apparatus of claim 1 wherein said rolling elements include cogwheels.

9. The apparatus for installing insulation on building walls comprising:

a carriage including an insulation roll support that supports rolls of insulation about a roll axis;

said insulation roll support including a pair of spaced-apart rails extending perpendicular to the roll axis for supporting rolls of insulation therebetween;

said rails having a length sufficient to support a plurality of rolls of insulation thereon parallel to one another;

said rails terminating at an insulation dispensing station whereat an insulation roll is rotatable about the roll axis while being held against movement along the rails.

10. The apparatus of claim 9 wherein said rails are toothed for cooperation with toothed sprockets on the insulation rolls.

11. The apparatus of claim 9 wherein said carriage includes base and upper frames, and said upper frame is hingedly connected to said base frame about a central hinge axis extending perpendicular to the roll axis to provide selective tilting movement of said upper frame relative to said base frame.

12. The apparatus of claim 9 including rolling elements movably supporting said carriage, and a crank drive mechanism for rotating said rolling elements.

13. The apparatus of claim 12 wherein at least some of said rolling elements include cogwheels.

14. The apparatus of claim 9 including a brake device movable into engagement with the outer periphery of a roll of insulation supported at said dispensing station.

15. The apparatus of claim 9 including a selectively operable insulation gripping device that grips and holds a strip of insulation hanging down from said carriage.

* * * * *